US012808294B2

(12) United States Patent
Freyer et al.

(10) Patent No.: US 12,808,294 B2
(45) Date of Patent: Nov. 24, 2026

(54) DOWNHOLE SENSOR ASSEMBLY FOR ALIGNMENT MEASUREMENT

(71) Applicant: Scientific Drilling International, Inc., Houston, TX (US)

(72) Inventors: Carsten Freyer, Wienhausen (DE); Karsten Zeiske, Celle (DE)

(73) Assignee: Scientific Drilling International, Inc., Houston, TX (US)

( * ) Notice: Subject to any disclaimer, the term of this patent is extended or adjusted under 35 U.S.C. 154(b) by 0 days.

(21) Appl. No.: 19/370,007

(22) Filed: Oct. 27, 2025

(65) Prior Publication Data

US 2026/0049548 A1 Feb. 19, 2026

Related U.S. Application Data

(63) Continuation of application No. 18/542,113, filed on Dec. 15, 2023, now Pat. No. 12,473,822.

(60) Provisional application No. 63/433,672, filed on Dec. 19, 2022.

(51) Int. Cl.
*E21B 47/024* (2006.01)

(52) U.S. Cl.
CPC ..... *E21B 47/024* (2013.01)

(58) Field of Classification Search
CPC ..... E21B 47/00; E21B 47/02; E21B 47/024
See application file for complete search history.

(56) References Cited

U.S. PATENT DOCUMENTS 4,933,640 A * 6/1990 Kuckes ..... E21B 47/0228 175/45
2015/0308260 A1* 10/2015 Kuckes ..... G01V 3/30 175/45
2016/0273344 A1* 9/2016 Wu ..... E21B 33/14

* cited by examiner

*Primary Examiner* — Kristyn A Hall
(74) *Attorney, Agent, or Firm* — Ewing & Jones PLLC

(57) ABSTRACT

A downhole alignment tool includes a guidance device, the guidance device having a center and a reference mark and a downhole sensor assembly, the downhole sensor assembly attached or positioned within the guidance device. The guidance device includes electronics, the electronics including an oscillator, an evaluation unit, and an output stage. A sensor detects a signal supplied to the evaluation unit for determining orientation of the reference mark relative to an object, such as another wellbore or casing.

15 Claims, 7 Drawing Sheets

DOWNHOLE SENSOR ASSEMBLY FOR ALIGNMENT MEASUREMENT

CROSS-REFERENCE TO RELATED APPLICATIONS

This application is a continuation application which claims priority from U.S. utility application Ser. No. 18/542,113, filed Dec. 15, 2023, which is itself a nonprovisional application which claims priority from U.S. provisional application No. 63/433,672, filed Dec. 19, 2022 which is incorporated by reference herein in its entirety.

TECHNICAL FIELD/FIELD OF THE DISCLOSURE

The present disclosure relates to a downhole sensor assembly for alignment measurement of a casing milling guidance device in reference to an in-situ casing.

BACKGROUND OF THE DISCLOSURE

During the life cycle of an oil well, an operator may need to gain hydraulic access to an existing cased wellbore when the wellbore is not accessible by typical re-entry procedures. For example, during the creation of the wellbore, if the wellbore penetrates a zone with pressure higher than the hydrostatic mud weight in the wellbore and pressure control systems fail, a blowout may occur that may result in the release of oil and/or natural gas. One method to control such a blowout is to drill a relief well to intercept the blowout wellbore.

As another example, at the end of a well's life cycle, a well is plugged and abandoned. Occasionally, the plugged and abandoned (P&A) well is improperly abandoned and may leak. Such a situation may require the drilling of an intercept well to fix and properly abandon the well.

In another example, during the drilling or completion phase of the well, a tubular "fish" or damaged tubular section may have been left in the well. An intercept well may be drilled to re-enter the wellbore to secure continued use of the wellbore and/or set abandonment plugs.

To gain hydraulic access to the existing cased wellbore, an operator may need to drill the intercept wellbore. Once the operator has drilled the intercept wellbore sufficiently close to the existing wellbore, a casing entry tool may be used to penetrate the existing tubular and gain hydraulic access thereto.

SUMMARY

The present disclosure describes a downhole alignment tool.

In some embodiments, a downhole alignment tool includes a guidance device to direct orientation of well operations and a downhole sensor assembly coupled to the guidance device. The downhole sensor assembly includes a sensing coil and first, second, third and fourth exciting coils displaced from one another in an arch arrangement having a midpoint with the first and second exciting coils on a first side of the midpoint and the third and fourth exciting coils on a second side of the midpoint. Oscillator electronics energize the exciting coils such that a first electromagnetic field from the first and fourth exciting coils is out of phase with a second electromagnetic field from the second and third exciting coils. An evaluation unit uses the sensing coil to detect a signal phase and amplitude resulting from the electromagnetic fields to determine distance from an object based on the signal amplitude and angular orientation relative to the object based on the signal phase.

For some embodiments, a method includes supplying a downhole alignment tool having a guidance device with a center and a reference mark and a downhole sensor assembly. The downhole sensor assembly couples to the guidance device and includes an oscillator, a first sensor; and a second sensor, with the first and second sensors separated by a 45° to 120° angle, the 45° to 120° angle measured from the center of the guidance device. The method further includes supplying power to the oscillator resulting in an electromagnetic field and causing a signal at the first sensor and the second sensor. In addition, the method includes measuring the signal strength at the first sensor and the second sensor and determining the angle between the reference mark and a casing circle point based on the signal strength at the first sensor and the second sensor.

In accordance with some embodiments, a downhole alignment tool includes a guidance device having a center and a reference mark in-line with a casing mill exit point of the guidance device and a downhole sensor assembly coupled to the guidance device. The downhole sensor assembly includes an oscillator to create an electromagnetic field, a first sensor to detect strength of the electromagnetic field and a second sensor to detect strength of the electromagnetic field, the first and second sensors separated by a 45° to 120° angle, the 45° to 120° angle measured from the center of the guidance device. An evaluation unit of the downhole sensor assemble compares signals from the first and second sensors and determines the reference mark is aligned with a center of a proximate wellbore when the signals of the first and second sensors match.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
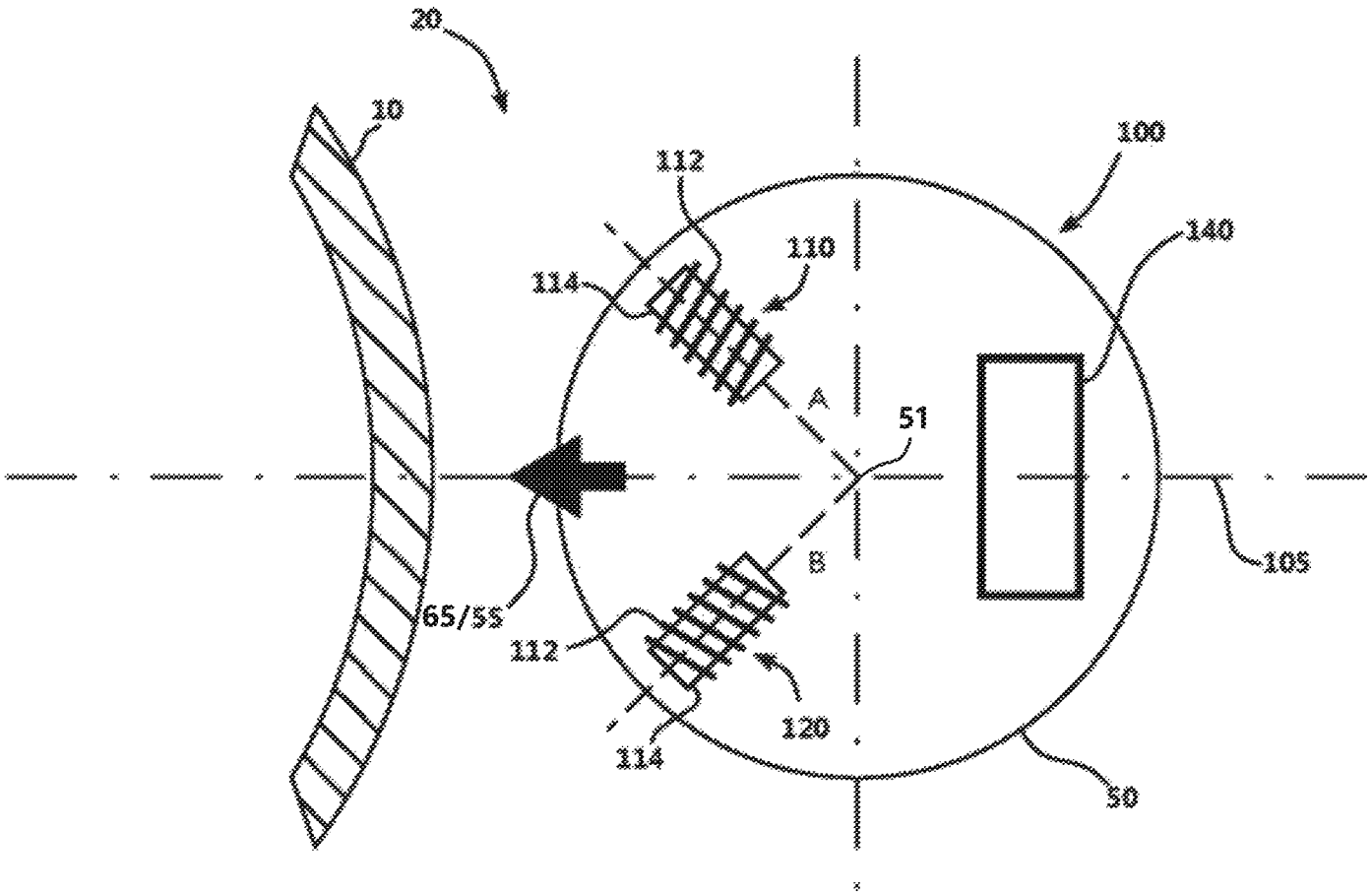
FIG. 1 is a transparent view of a downhole sensor assembly within or attached to a guidance device in proximity to casing consistent with certain embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The present disclosure includes embodiments of a downhole alignment tool (identified by reference number 20 in FIGS. 1-3 or reference number 420 in FIGS. 4 and 5) that measures the alignment, such as the absolute orientation, of a guidance device for milling/drilling operation with reference to an in-situ casing. For some embodiments, the sensor arrangement may include at least two sensitive coils displaced from one another by a 45° to 120° angle, or from a 75° to 100° angle, or a 90° angle. The sensor arrangement according to alternative embodiments includes multiple exciting coils disposed about a semicircle and facing a sensing coil. The sensor arrangement may be attached or built into the guidance device and may be aligned with a reference mark (high-side) of the guidance device. The reference mark may be located on the bisecting line of the 90° angle or the midpoint of the semicircle. In some embodiments, the sensor signal may provide the angular measurement, for example, the alignment of the guidance device high-side to the casing circle point.

Having a sensor signal that measures the high-side orientation of the casing milling guidance device may provide the position of the casing mill entry point. In some embodiments, the high-side reference mark is in-line with casing mill exit point of the guidance device. Measurement of the guidance device orientation with reference to the casing circle point may allow the milling process to begin at the centerline of the casing.

FIG. 1 depicts downhole sensor assembly 100 within or attached to guidance device 50 in proximity to casing 10. Downhole sensor assembly 100 includes first sensor 110 and second sensor 120. The first sensor 110 and the second sensor 120 each include sensitive coil 112 and ferrite core 114, wherein sensitive coil 112 is positioned about ferrite core 114. In certain embodiments, ferrite core 114 is a half pot core. The first sensor 110 and second sensor 120 are displaced by a 45° to 120° angle, or from a 75° to 100° angle, or a 90° angle, as measured from a center 51 of guidance device 50 (i.e., from point on a centerline 105 of guidance device 50 where equidistant to opposite sides of the guidance device 50 along the centerline 105). In certain embodiments, first sensor 110 and second sensor 120 may be aligned with reference mark 55, for example, by locating first sensor 110 and second sensor 120 such that reference mark 55 is located on the bisecting line of the angle. The reference mark 55 as used herein and depicted by a representational arrow in the figures identifies a known/desired position (with, or without, an actual marking on the downhole alignment tool 20) around the guidance device 50 for use in aligning the guidance device 50 that thereby directs orientation of well/drilling operations, such as milling when the reference mark 55 corresponds with a casing mill exit point 65.

Figure 2:
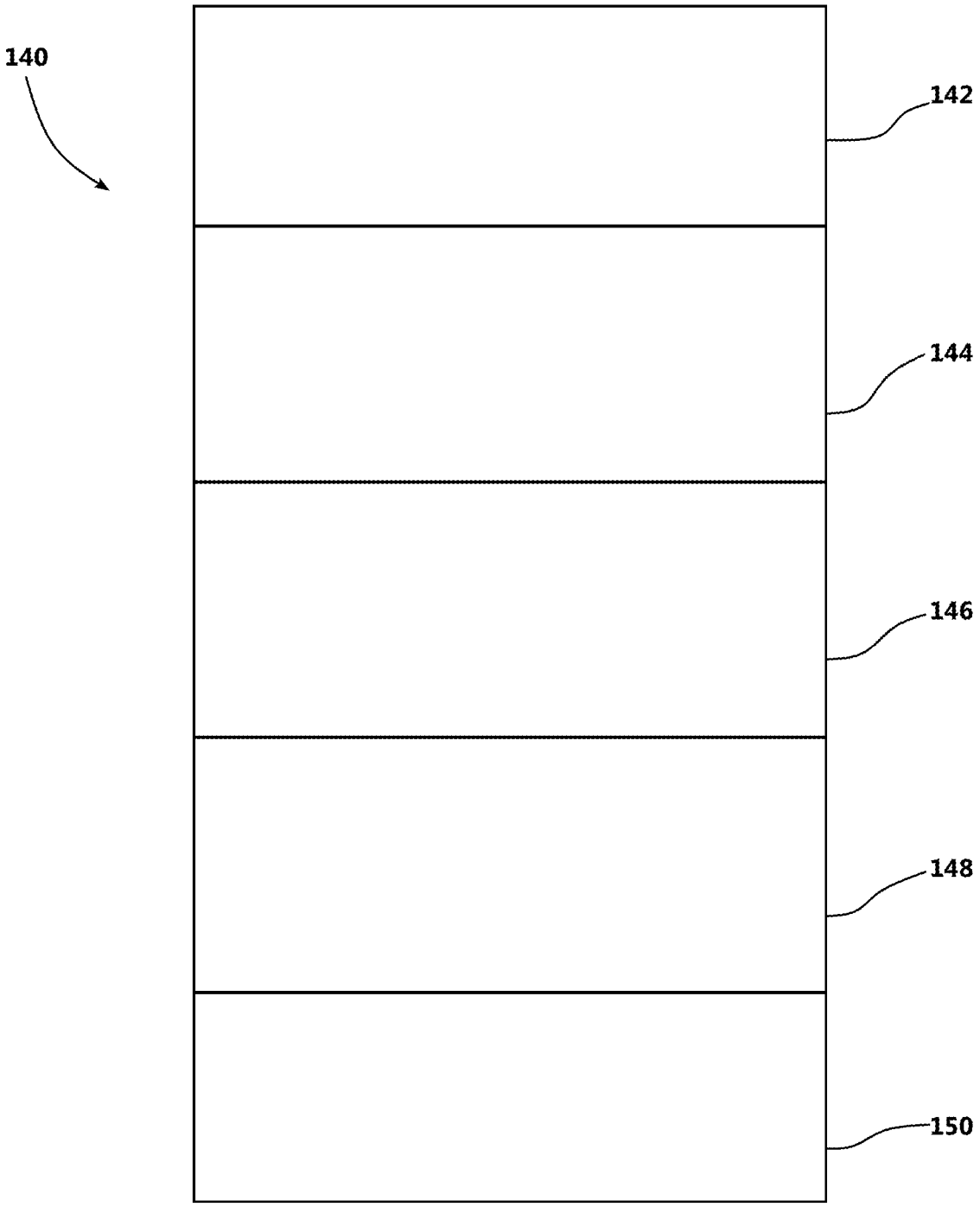
FIG. 2 is a schematic view of electronics of a downhole sensor assembly consistent with certain embodiments of the present disclosure.

Downhole sensor assembly may also include electronics 140. As shown in FIG. 2, electronics 140 may include oscillator 142, evaluation unit 144, output stage 146, power supply 148, and battery 150. In certain embodiments, power may be supplied from the surface and battery 150 or a combination of battery 150 and power supply 148 may be omitted.

Power may be supplied to oscillator 142. When power is supplied to oscillator 142, oscillator 142 will oscillate. The resulting electromagnetic field is directed forward to the active surface of sensitive coils 112 by means of first sensor 110 and second sensor 120. An approaching object, such as casing 10, or even an actuating element, e.g., the wellbore, withdraws energy from the oscillating circuit formed by oscillator 142, first sensor 110 and second sensor 120, whereupon the current through sensitive coils 112 decreases in accordance with the distance from the sensitive coils 112 but the voltage across sensitive coils 112 decreases in accordance to the distance from each sensitive coil 112. Evaluation unit 144 relates the current through sensitive coils 112 and determines the absolute reduction of the current, thus generating a signal for the relative position of the object between sensitive coils 112 and the distance from sensors 110 and 120.

Output stage 146 produces the signal in an analog or digital form for use or transmission.

Power to downhole sensor assembly 100 may be supplied, for example, from a battery, such as an internal battery, from a MWD apparatus, or from the surface.

Figure 3A:
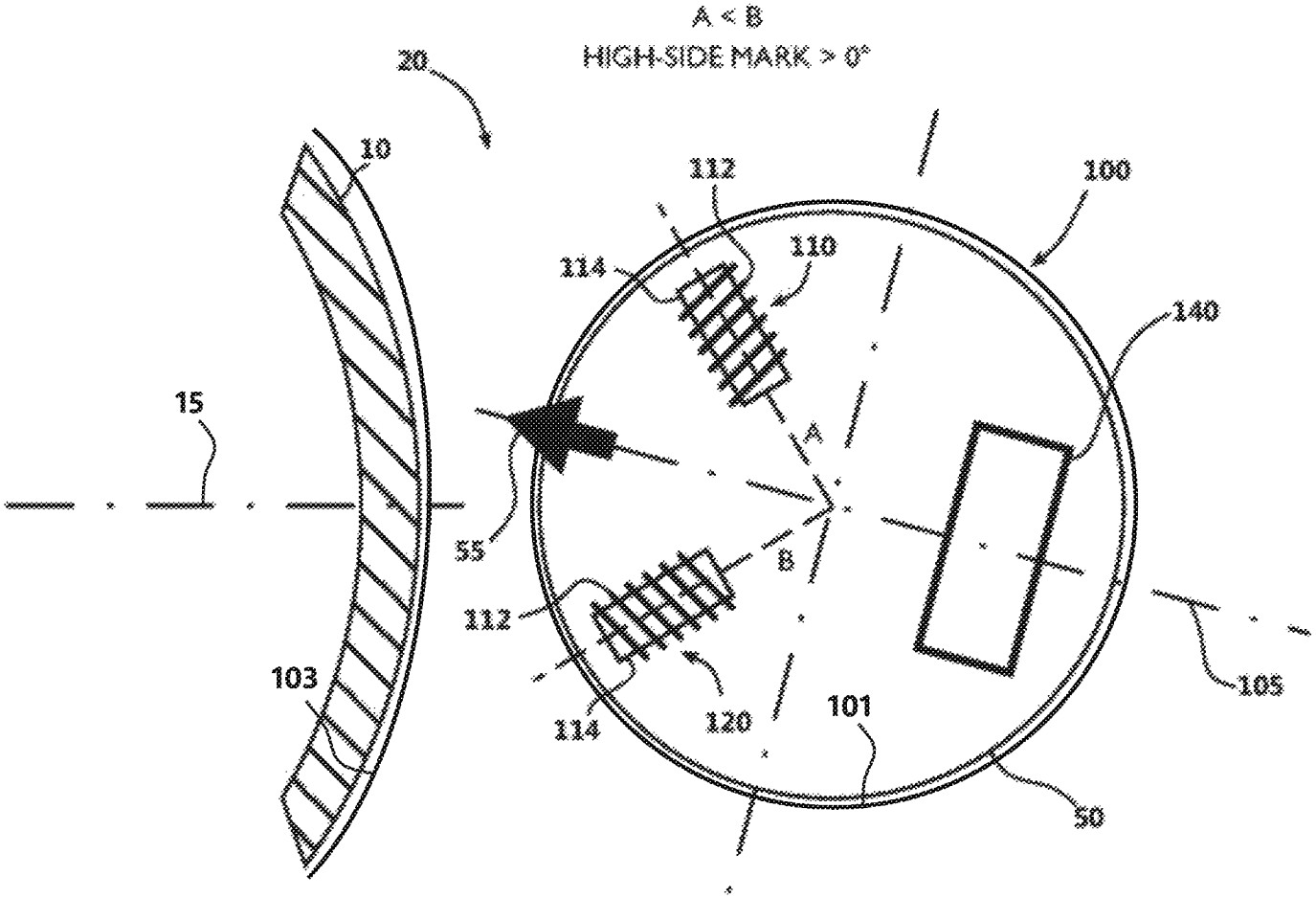
FIGS. 3A, 3B, and 3C are transparent views of the downhole sensor assembly of FIG. 2 showing different orientations consistent with certain embodiments of the present disclosure.
Figure 3B:
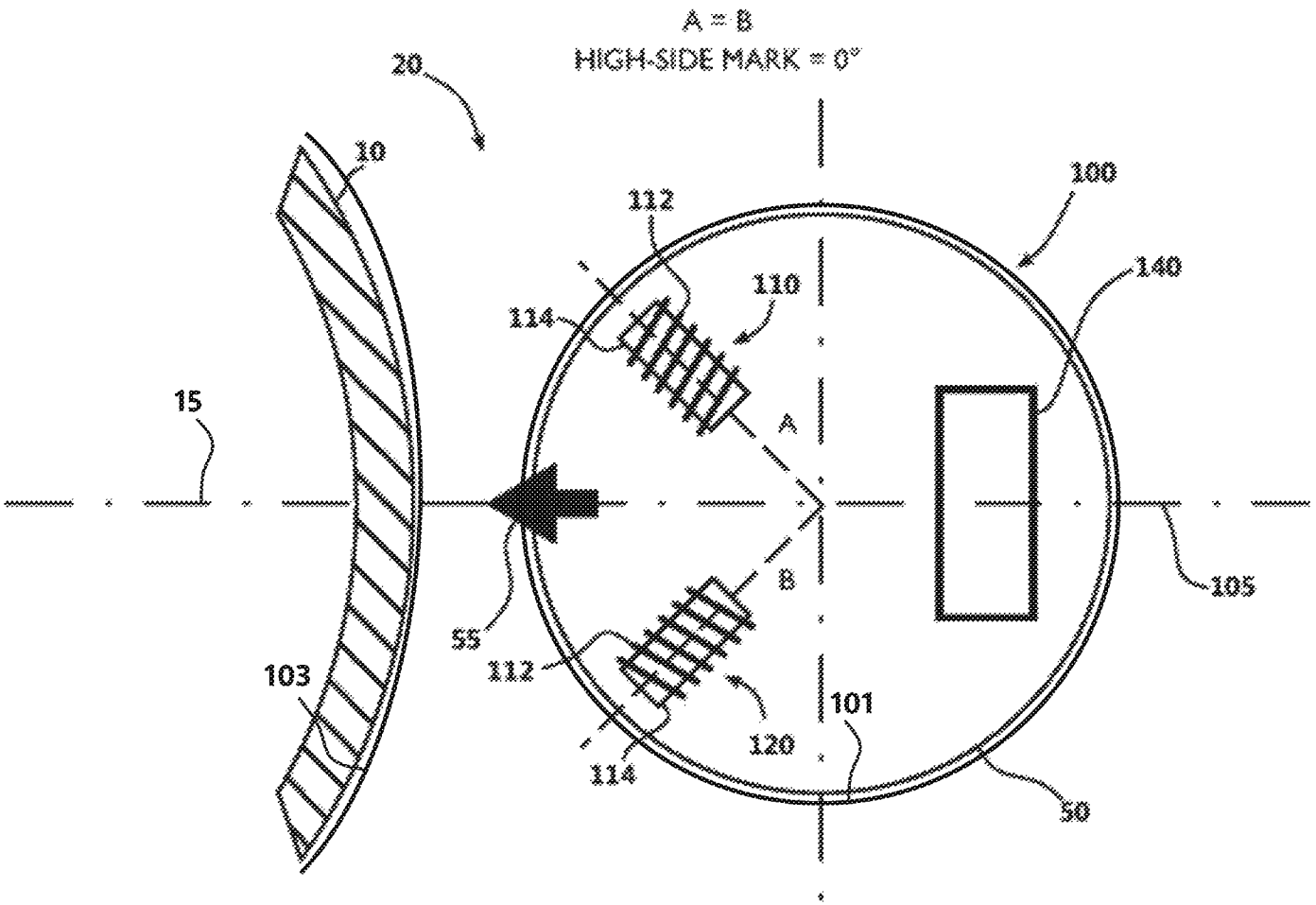
Figure 3C:
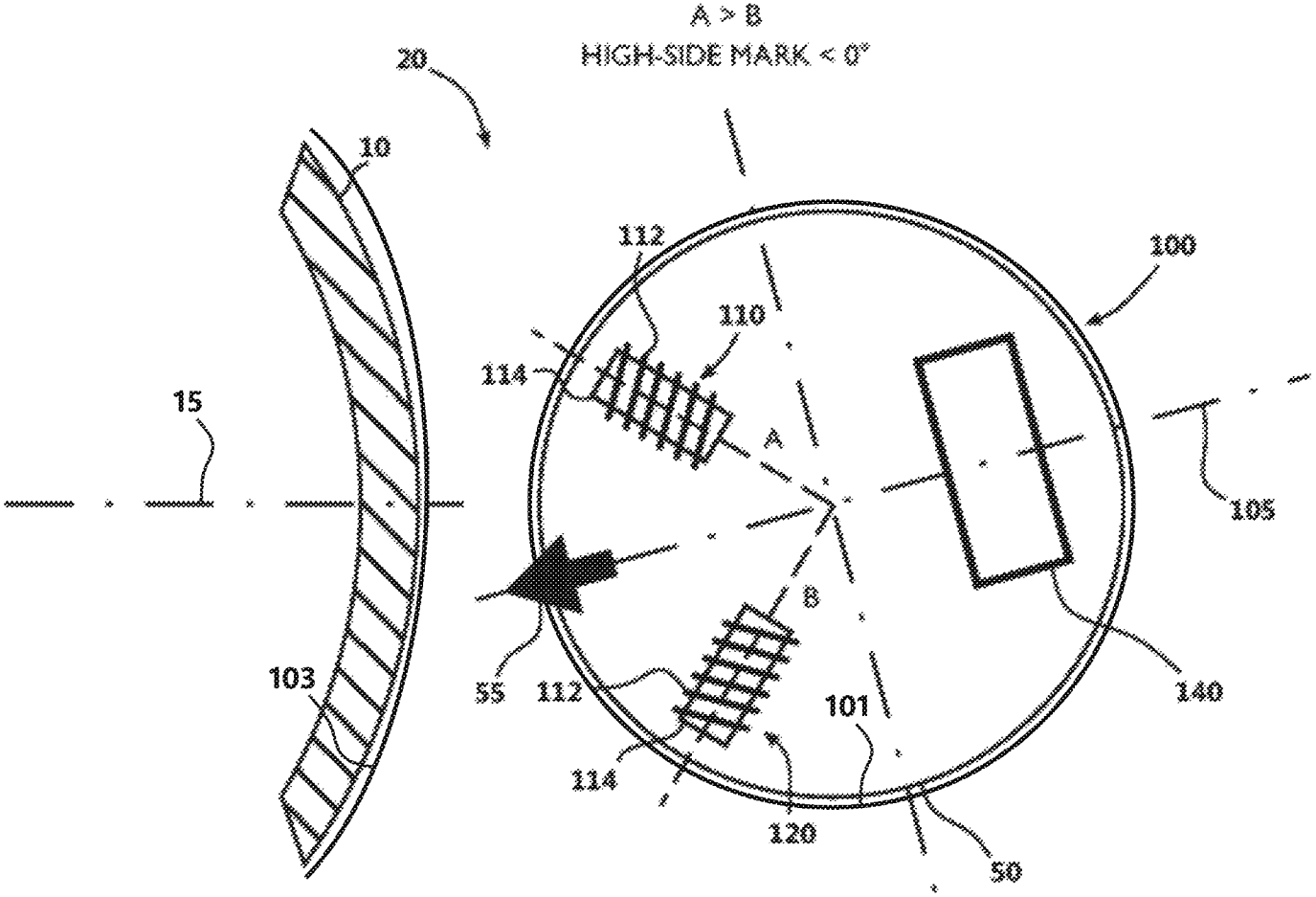

Signals from first sensor 110 and second sensor 120 provide the angular measurement, i.e., the alignment of guidance device 50 high-side to the casing circle point 15, i.e. the center point of casing 10 as shown in FIGS. 3A, 3B, and 3C. As shown in FIG. 3A, a sensor strength signal from first sensor 110 is less than that of second sensor 120, indicating that the angle to reference mark 55 from the casing circle point is greater than 0°. In FIG. 3B, the sensor signal strength of first sensor 110 is equal to that of second sensor 120, indicating that the angle to reference mark 55 from the casing circle point is equal to 0°. In FIG. 3C, the sensor signal strength of first sensor 110 is greater than that of second sensor 120, indicating that the angle to reference mark 55 from the casing circle point is less than 0°. By adjusting guidance device 50 such that the angle from the reference mark 55 from the casing circle point is at or near 0°, the cutting or milling of casing 10 can be done at the centerline of casing 10. Cutting or milling of casing 10 at the centerline of casing 10 improves the success rate and efficiency of the casing entry milling/cutting operation. In addition, cutting or milling at 0° improves the success rate of accessing the inside of the casing with a cement stringer for a plug and abandonment cementing job. In some embodiments, the guidance device 50 is in an intercept well 101 with a separate borehole path to surface from a wellbore 103 with the casing 10.

Figure 4:
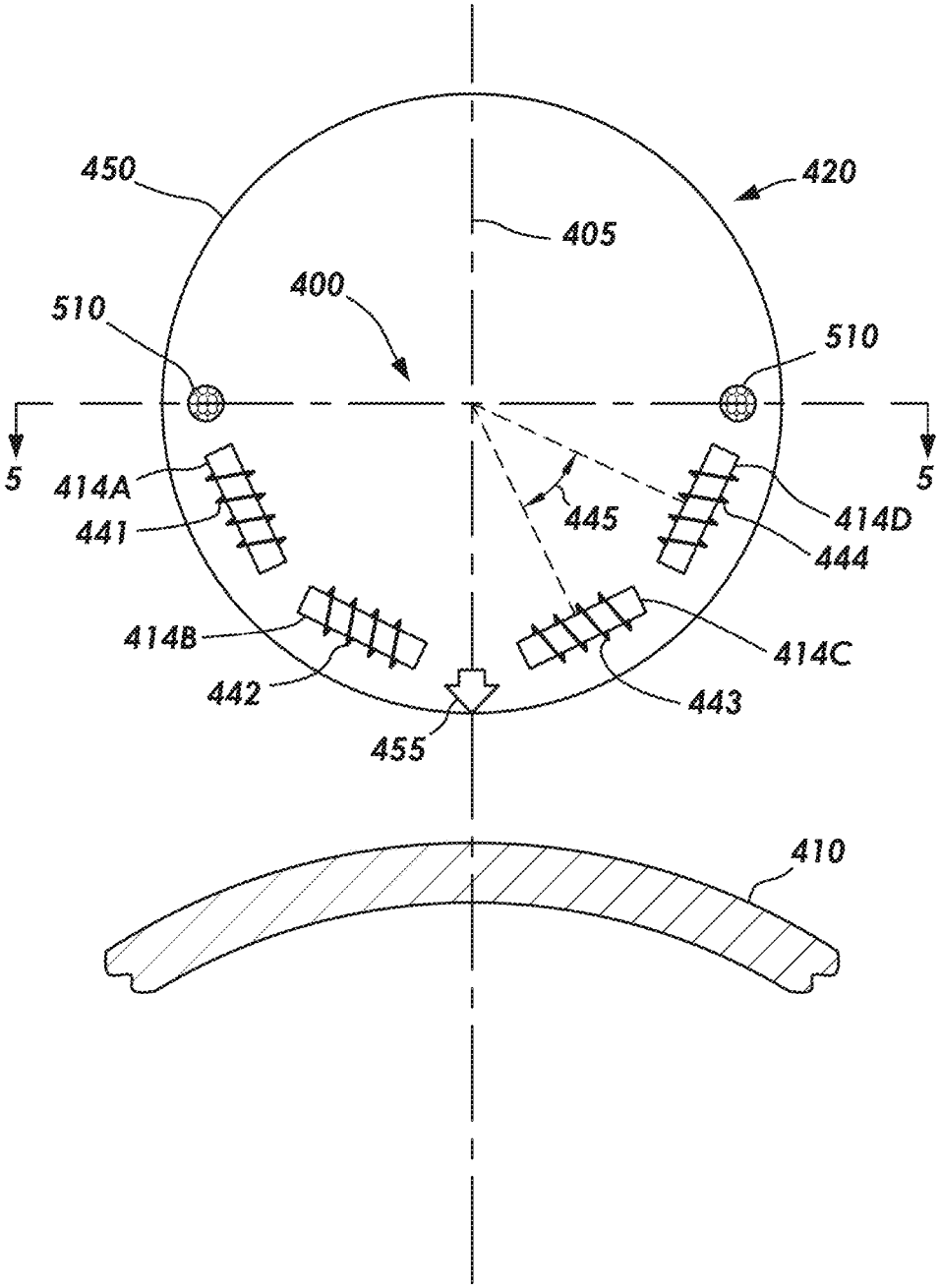
FIG. 4 is a transparent view of another downhole sensor assembly within or attached to a guidance device in proximity to casing consistent with certain embodiments of the present disclosure.

FIG. 4 shows another downhole sensor assembly 400 that includes first, second, third and fourth exciting coils 441, 442, 443, 444 displaced from one another in an arch arrangement having a midpoint. A centerline 405 of guidance device 450 passes through both reference mark 455 and the midpoint with the first and second exciting coils 441, 442 on a first side of the midpoint or the centerline 405 opposite the third and fourth exciting coils 443, 444 on a second side of the midpoint or the centerline 405. Placement of the exciting coils 441, 442, 443, 444 thus provides symmetry left and right of the midpoint or the centerline 405. The arch arrangement of the exciting coils 441, 442, 443, 444 may be along a transverse plane perpendicular to a longitudinal axis of the guidance device 450. To facilitate signal processing, an angle (identified by reference number 445) of 45° may separate centers of the exciting coils 441, 442, 443, 444 from one another along the arch arrangement, which may be a semicircle in some embodiments. Each of the exciting coils 441, 442, 443, 444 may be disposed about a respective ferrite core 414A, 414B, 414C, 414D, which may be rod cores. In a similar way with reference to FIGS. 3A-3C as described herein, the reference mark 455 identifies position around the guidance device 450 for use in aligning the guidance device 450 with an object, for example casing 410, to orient well/drilling operations using the guidance device 450.

Figure 5:
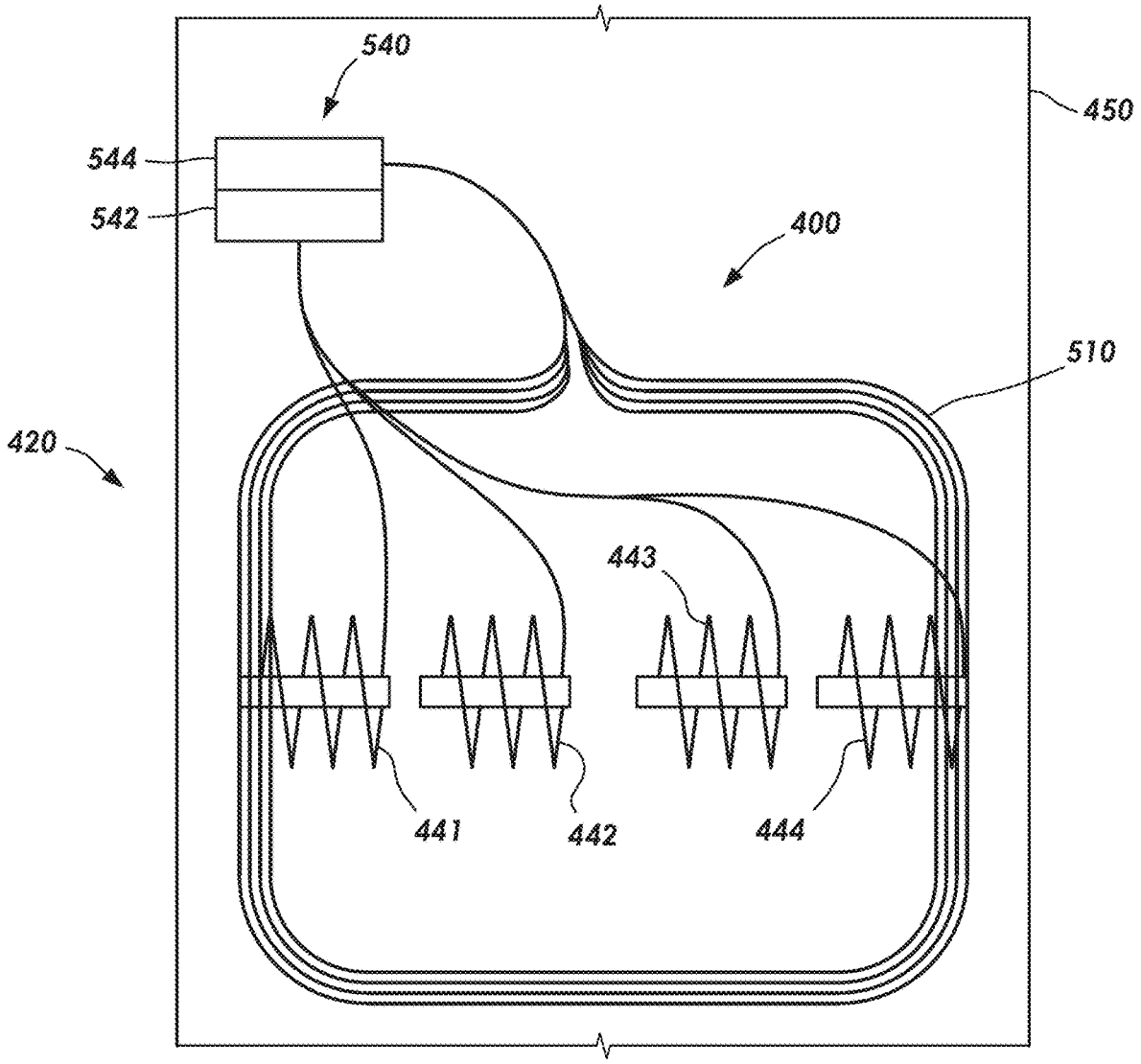
FIG. 5 is a side view taken across line 5-5 of the downhole sensor assembly shown in FIG. 4.

As illustrated in FIG. 5, the downhole sensor assembly 400 further includes a sensing coil 510 that forms a loop along a sensing plane parallel to a longitudinal axis of the guidance device 450 and perpendicular to the centerline 405 between a center of the guidance device 450 and the midpoint of the arch arrangement of the exciting coils 441, 442, 443, 444. The loop of the sensing coil 510, which may comprise wound wire, may have a rectangular shape encircling above and below height of the exciting coils 441, 442, 443, 444 and laterally encircling extent of the exciting coils 441, 442, 443, 444 along width of the arch arrangement. The sensing coil 510 and the exciting coils 441, 442, 443, 444 couple to electronics 540, which may include any of the components as shown and described with respect to FIG. 2.

The exciting coils 441, 442, 443, 444 couple to oscillator electronics 542 that energize the exciting coils 441, 442, 443, 444 such that a first electromagnetic field from the first and fourth exciting coils 441, 444 located furthest from the midpoint or the centerline 405 is out of phase, for example by 90°, with a second electromagnetic field from the second and third exciting coils 442, 443 located closest to the midpoint or the centerline 405. The oscillator electronics 542 produces the same frequency of the electromagnetic fields from the exciting coils 441, 442, 443, 444 for detection of the frequency by the sensing coil 510 and evaluation unit 544. The evaluation unit 544 couples to the sensing coil 510 used to detect a signal phase and amplitude resulting from the electromagnetic fields produced with the exciting coils 441, 442, 443, 444 to determine distance from the casing 410 based on the signal amplitude and angular orientation relative to the casing 410 based on the signal phase.

In operation, casing 410 affects the electromagnetic fields from the exciting coils 441, 442, 443, 444 at the sensing coil 510 for detection with a phase sensor (e.g., a multiplier) and an amplitude sensor of the evaluation unit 544. The amplitude as detected with the sensing coil 510 and evaluation unit 544 increases as the casing 410 approaches the guidance device 450. When the reference mark 455 is aligned with casing 410 as shown in FIG. 4, the left and right symmetry of both the first and fourth exciting coils 441, 444 and the second and third exciting coils 442, 443 provides the resulting signal as detected at the sensing coil 510 with evaluation unit 544 that has a 45° phase difference from both the first electromagnetic field from the first and fourth exciting coils 441, 444 and the 90° phase shifted second electromagnetic field from the second and third exciting coils 442, 443. If the reference mark 455 is right of casing 410, phase difference at the sensing coil 510 compared to what is sensed when the reference mark 455 is aligned with casing 410 would be less than 45°. Detecting a phase difference at the sensing coil 510 that is greater than 45° relative to what is sensed when the reference mark 455 is aligned with casing 410 likewise thus indicates the reference mark 455 is left of casing 410.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method, comprising:

supplying a downhole alignment tool comprising:

a guidance device, the guidance device having a center and a reference mark; and a downhole sensor assembly, the downhole sensor assembly coupled to the guidance device, wherein the downhole sensor assembly includes:

an oscillator;

a first sensor; and a second sensor, the first and second sensors separated by a 45° to 120° angle, the 45° to 120° angle measured from the center of the guidance device;

supplying power to the oscillator resulting in an electromagnetic field and causing a signal at the first sensor and the second sensor;

measuring the signal strength at the first sensor and the second sensor; and determining the angle between the reference mark and a casing circle point based on the signal strength at the first sensor and the second sensor.

2. The method of claim 1, wherein the first sensor and the second sensor each include a ferrite core and a sensitive coil positioned about the ferrite core.

3. The method of claim 2, wherein the ferrite core is a half pot core.

4. The method of claim 1, wherein first sensor and the second sensor are aligned such that the reference mark is located on a bisecting line of a 90° angle that the first and second sensors are separated.

5. The method of claim 1, wherein the downhole sensor assembly further includes a power supply or a battery.

6. The method of claim 1, further comprising milling toward a center of casing from outside of the casing to inside of the casing based on the determining of the angle between the reference mark and the casing circle point.

7. The method of claim 1, wherein the reference mark is in-line with a casing mill exit point of the guidance device and milling is initiated when the angle between the reference mark and the casing circle point is determined to be 0.

8. The method of claim 1, wherein the downhole alignment tool is disposed in an intercept well separate and in proximity to a wellbore providing the casing circle point.

9. The method of claim 1, wherein the reference mark is in-line with a casing mill exit point of the guidance device.

10. The method of claim 1, further comprising aligning the guidance device to where the angle between the reference mark and the casing circle point is determined to be 0 for entry into a wellbore.

11. A downhole alignment tool, comprising:

a guidance device having a center and a reference mark in-line with a casing mill exit point of the guidance device; and a downhole sensor assembly coupled to the guidance device, wherein the downhole sensor assembly includes:

an oscillator to create an electromagnetic field;

a first sensor to detect strength of the electromagnetic field;

a second sensor to detect strength of the electromagnetic field, the first and second sensors separated by a 45° to 120° angle, the 45° to 120° angle measured from the center of the guidance device; and an evaluation unit to compare signals from the first and second sensors, wherein the evaluation unit determines the reference mark is aligned with a wellbore when the strength of the electromagnetic field indicated by the signals of the first and second sensors match.

12. The downhole alignment tool of claim 11, wherein the first sensor and the second sensor each include a ferrite core and a sensitive coil positioned about the ferrite core.

13. The downhole alignment tool of claim 12, wherein the ferrite core is a half pot core.

14. The downhole alignment tool of claim 11, wherein first sensor and the second sensor are aligned such that the reference mark is located on a bisecting line of a 90° angle that the first and second sensors are separated.

15. The downhole alignment tool of claim 11, wherein first sensor and the second sensor are aligned such that the reference mark is located on a bisecting line of the 45° to 120° angle.

* * * * *